US006739075B2

(12) United States Patent
Sizemore

(10) Patent No.: US 6,739,075 B2
(45) Date of Patent: May 25, 2004

(54) SHOCK ABSORBERS FOR FOOTWEAR

(76) Inventor: Johnny Chad Sizemore, 628 Lantern Ridge Dr., Winston-Salem, NC (US) 27104

( * ) Notice: Subject to any disclaimer, the term of this patent is extended or adjusted under 35 U.S.C. 154(b) by 0 days.

(21) Appl. No.: 10/222,381

(22) Filed: Aug. 16, 2002

(65) Prior Publication Data

US 2003/0033731 A1 Feb. 20, 2003

Related U.S. Application Data

(60) Provisional application No. 60/312,836, filed on Aug. 17, 2001.

(51) Int. Cl.[7] ..... A43C 15/00
(52) U.S. Cl. ..... 36/61
(58) Field of Search ..... 36/61, 128, 134

(56) References Cited

U.S. PATENT DOCUMENTS 1,361,078 A * 12/1920 Lynn ..... 36/61
5,289,647 A * 3/1994 Mercer ..... 36/134
5,351,422 A * 10/1994 Fitzgerald ..... 36/134
5,732,482 A * 3/1998 Remington et al. ..... 36/61
6,079,127 A * 6/2000 Nishimura et al. ..... 36/61
6,550,160 B2 * 4/2003 Miller, II ..... 36/127

FOREIGN PATENT DOCUMENTS

FR 2567004 * 1/1986

* cited by examiner

*Primary Examiner*—Ted Kavanaugh

(57) ABSTRACT

Shock absorbers for footwear are provided. The shock absorbers are units utilizing a shock absorbing spring system, and project like cleats from recesses in the soles of footwear. The shock absorbers serve to minimize impact shock in the normal use of footwear. The shock absorbers do this by compressing as weight is applied to the shoe, to the point that the shock absorbers may become flush with the bottom of the shoe's sole on normal impact if desired. When weight is released from the shoe (for example, in lifting one's foot to take a step), the re-extension of the shock absorber spring system may additionally provide the benefit of energy return for the user. The shock absorbers may be made as either fixed or as detachably interchangeable projections from the sole of the footwear. The shock absorbers may also be arranged in any number, order or pattern on the sole as desired to affect the amount or distribution of shock absorption for the user, but are preferably aligned in a configuration primarily set on the normal pressure points of the foot during impact, considering weight, balance and center of gravity of the expected user. The amount of shock absorption provided by each shock absorber may also be varied as desired.

17 Claims, 6 Drawing Sheets

SHOCK ABSORBERS FOR FOOTWEAR

This application claims the priority benefit of Provisional Application No. 60/312,836, filed Aug. 17, 2001.

BACKGROUND OF THE INVENTION

The present invention relates to the field of shock absorbing mechanisms associated with footwear.

Walking and running expose an individual's feet and body to repeated shocks from impact which may result in injury or discomfort to the individual. For example, individuals in the workplace that need to walk or work on flat hard surfaces such as concrete, asphalt, hard floors, tile, wood, or shallow carpet for extended periods of time particularly need footwear with strong shock absorption features. Hospital, office, restaurant, manufacturing, and garage workers, and senior citizens, may fit this group of individuals having a particular need for shock absorbing footwear. As a result, various designs for shock absorbing footwear have emerged over the years, including soles made of various impact-absorbing materials. In addition, some shoes have utilized springs within the shoe soles, likewise designed to perform shock absorbing functions.

One disadvantage that exists in the above prior art footwear is that the shock absorbing features of the footwear are generally not adjustable to customize the shock absorption to the particular, varying needs or desires of the individual user. For example, with typical prior art shoes, a user does not have the option of increasing or lowering the amount of shock absorption to accommodate changing from soft to hard walking surfaces, or vice versa. In addition, with typical prior art shoes, a user does not have the option of adjusting the amount or distribution of shock absorption as applied to different parts of the user's feet, such as increasing the amount of shock absorption in the heel area when needed, as an example.

Another disadvantage that exists in the prior art is that there is generally no inexpensive or easy way to replace or renew the shock absorption features in prior art footwear once the shock absorption performance of the shoe begins to decline over time and extended use. For example, prior art shoes with declined shock absorption performance would generally need to be resoled or completely replaced in order to regain full performance, and the user would have no convenient or less wasteful option of simply replacing or changing the worn shock absorbing springs or other mechanisms alone by hand.

A third disadvantage that exists in the prior art is that footwear with higher shock absorption qualities will generally require thicker shoe soles, which may be undesirable to the user.

A fourth disadvantage that exists in the prior art is that a single piece of footwear is not easily converted for different uses, such as converting between a comfortable walking shoe with high shock absorption qualities to a more responsive athletic shoe with cleats for better responsiveness and traction in return for the decrease in shock absorption value. Users instead typically buy multiple pairs of shoes for use in such different situations, which may be disadvantageous and wasteful in terms of time or money for the user.

SUMMARY OF THE INVENTION

The present invention provides cleat-like shock absorbers for footwear that meet one or more of the existing needs in the prior art, as set forth above.

LEXICOGRAPHY

The preferred embodiment of the shock absorber of the present invention is at times referred to herein as a "spring cleat" or "cleat." This terminology is used for sake of convenience and ease of understanding, as the shock absorbers, when attached to footwear under the preferred embodiment, may take on the appearance and location of traditional shoe cleats. Nevertheless, the use of the term "cleat" herein for the shock absorbers is not intended to imply that the shock absorbers are designed to be used for gripping or traction purposes, nor are the claims of this invention to be read as restricting the scope of the present invention to require the shock absorbers to perform traditional shoe cleat functions such as for improving footwear grip or traction.

DETAILED DESCRIPTION OF THE DRAWINGS

It will be understood by those with skill in the art that the present invention may be incorporated and used in a wide number of potential embodiments falling within the claims of the present invention. This description therefore shall be taken as illustrative of a preferred embodiment of the invention only, and should not be construed as an intent to limit the claims of the present invention to particular embodiments specifically described and illustrated herein.

Figure 1:
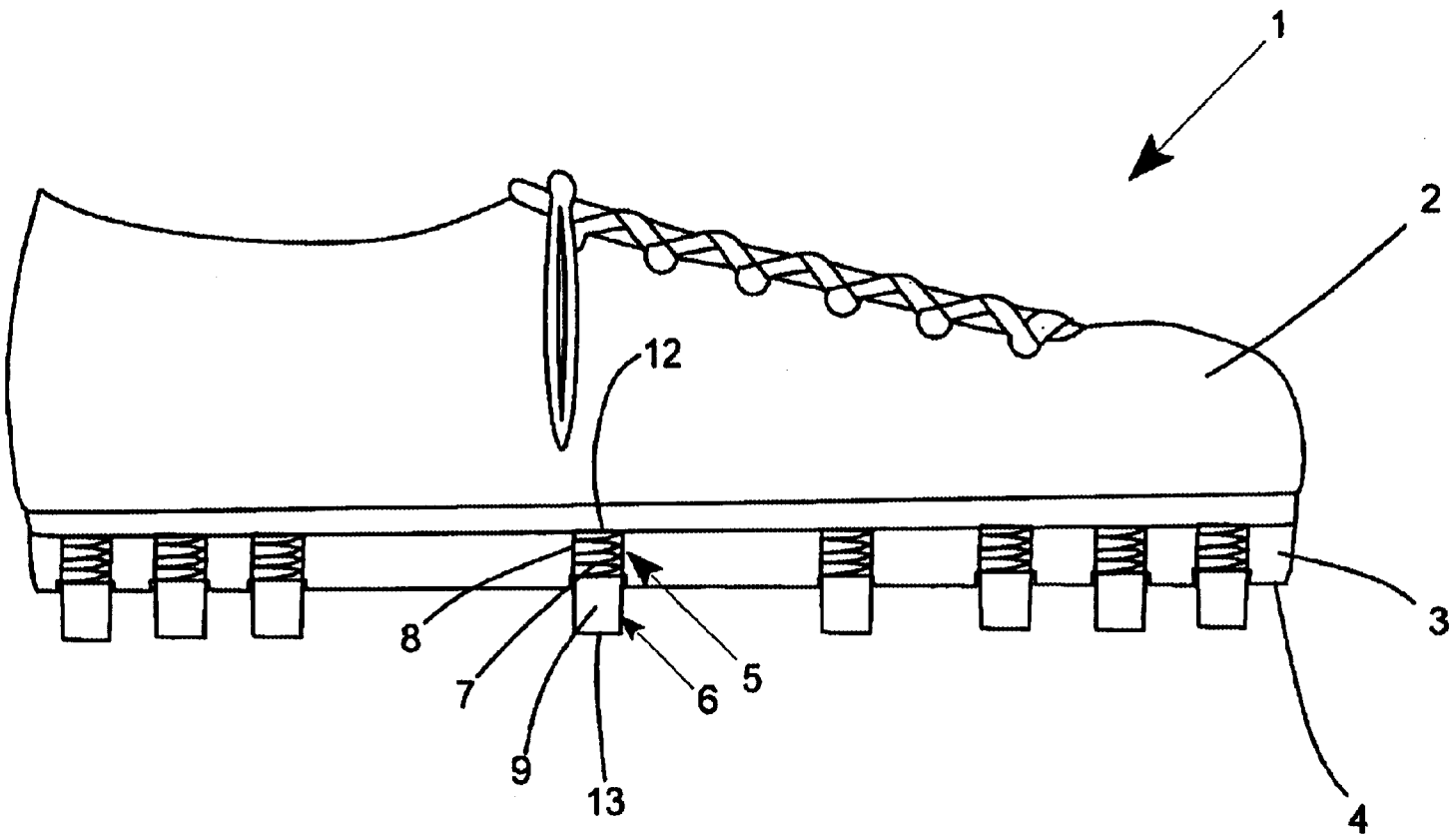
FIG. 1 is a side view showing footwear with shock absorbers, with uncompressed springs, according to the preferred embodiment of the invention.

FIG. 1 shows shoe 1, including an upper portion 2 for enclosing the foot, as well as a sole portion 3 for supporting the foot above the ground. Upper portion 2 and sole 3 may be made of any number of conventional materials (e.g. leather, rubber, etc.) to fit the comfort and styles preferred by the user. In the preferred embodiment of the invention, the bottom surface 4 of sole 3 is designed as a contact walking surface of shoe 1, and thus may be adapted to contain treads or other features for traction and user comfort as is commonly available in the prior art. In addition, a hard protective section 14 may be added to shoe 1, interposed between upper portion 2 and sole 3. Protective section 14 may serve to protect the foot from upward pressures created by springs 7 or serve other useful functions apparent to those with ordinary skill in the art. The wearer is protected from discomfort from the spring pressure through the sole 3 by use of protective section 14 and/or a strong wall 12 to enclose spring 7, together with maintaining a safe distance between the foot and the spring 7 if desired.

Figure 2:
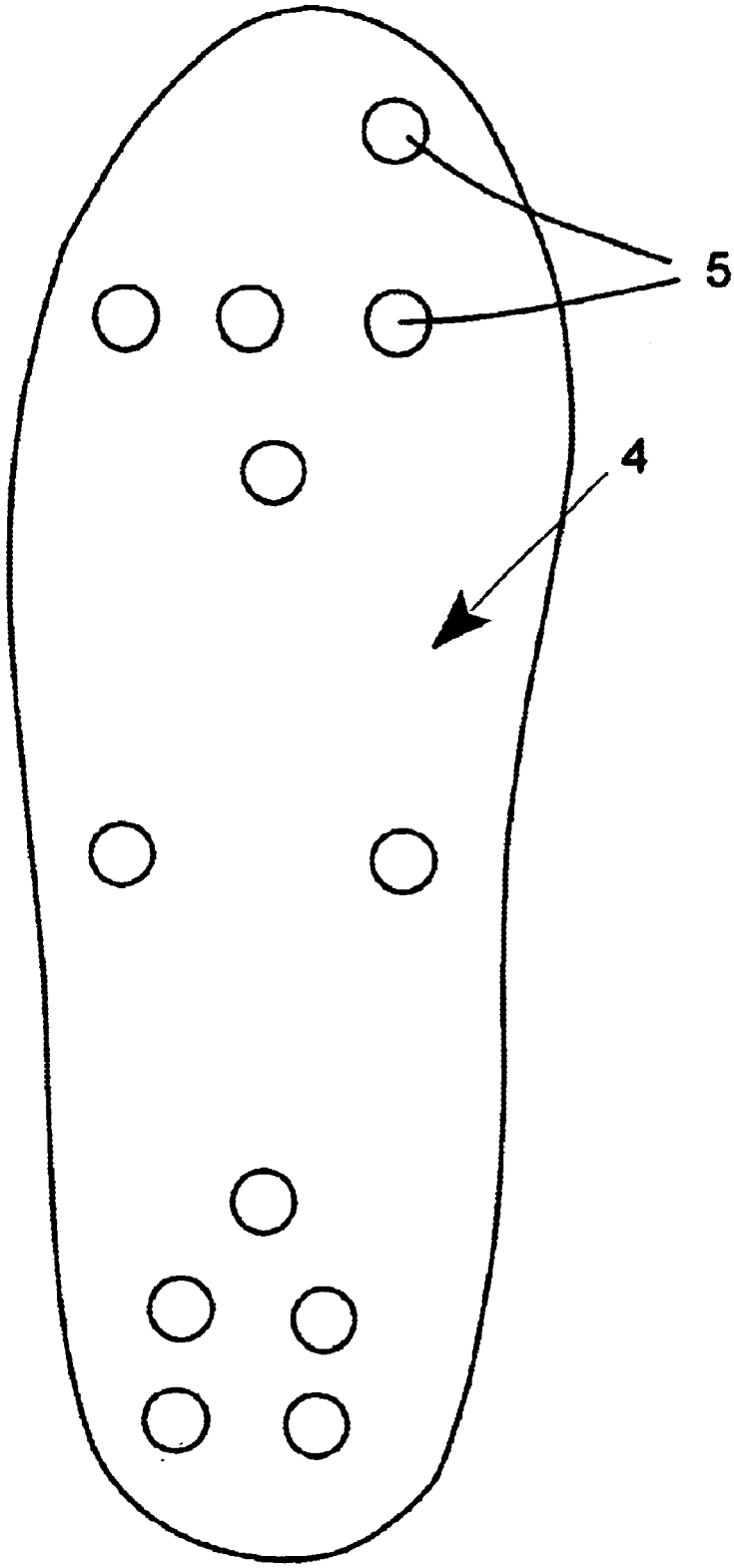
FIG. 2 is a bottom view of footwear showing potential placement and distribution of the shock absorbers in the preferred embodiment of the invention.
Figure 3:
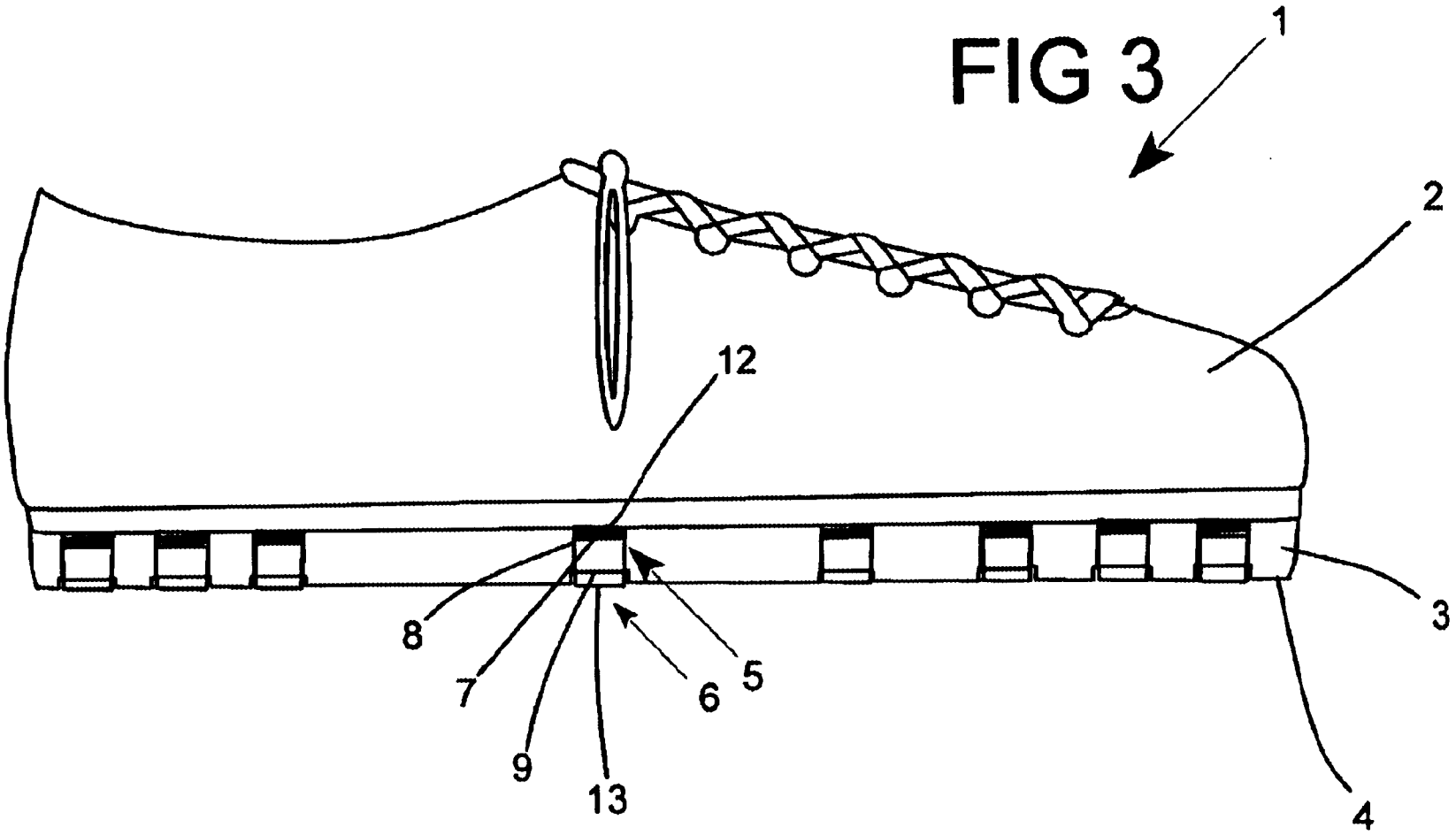
FIG. 3 is a side view showing footwear with shock absorbers, with fully compressed springs, according to the preferred embodiment of the invention.
Figure 5:
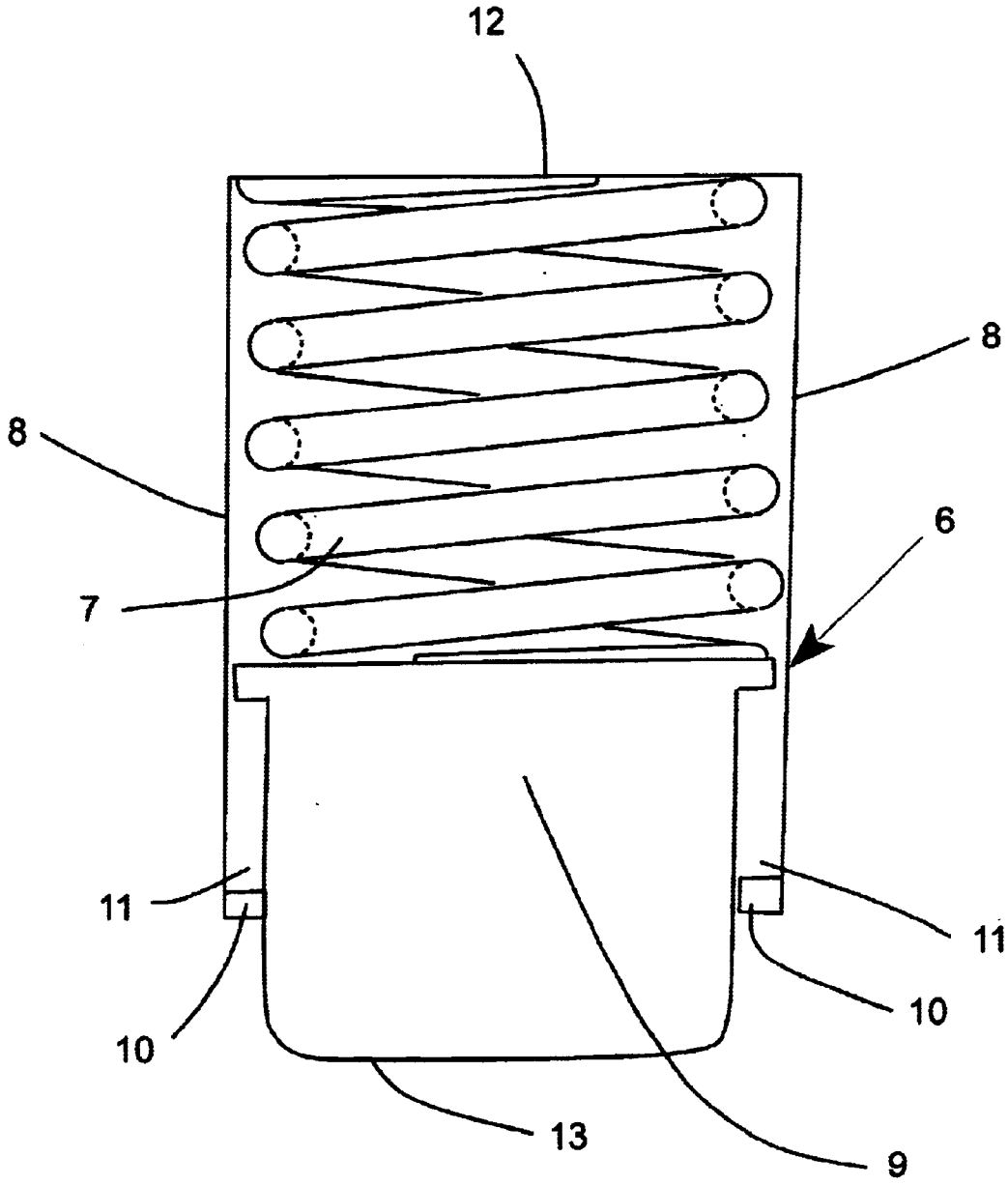
FIG. 5 is a side view of a shock absorber, with a compressed spring, according to the preferred embodiment of the invention.
Figure 6:
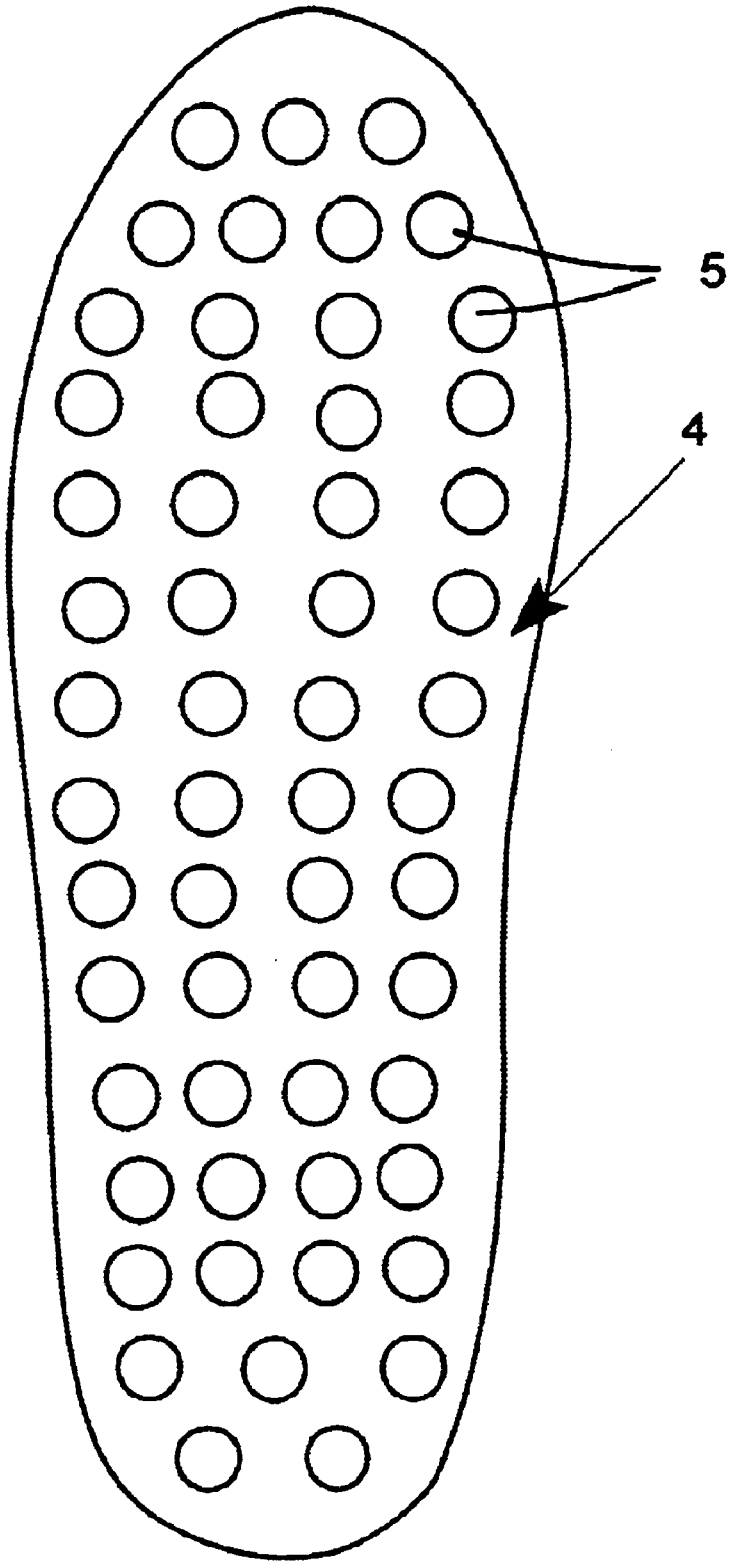
FIG. 6 is a bottom view of footwear showing a sample alternative placement and distribution of sole recesses designed to accept shock absorbers in the invention.

In the preferred embodiment of the invention, sole 3 is constructed to contain various recesses 5 in surface 4, as shown in FIGS. 2 and 6. Any number or pattern of recesses 5 may be used, as is shown by the different sample numbers and patterns of recesses 5 shown in FIGS. 2 and 6. The recesses 5 are designed to receive shock absorbers 6, as shown in FIGS. 1 and 3. Recesses 5 may be threaded, if desired, to accommodate optional complementary threading of the shock absorbers 6 for screwing in shock absorbers 6 into the recesses 5. Alternatively, the cleats 6 may be secured into the bottom of the sole by other means, such as a notch system (i.e. the cleat 6 may have notches that allow the cleat to slide into the recess but lock therein once inserted) or by molding, as is commonly available in the prior art. Threading would also be accomplished by conventional means readily available in the prior art. Aspects of shock absorbers 6, meanwhile, are shown in greater detail in FIGS. 4 and 5. Typical locations for the shock absorbers 6 would be underneath the heel, big toe, and ball region of the foot, as such locations are typical stress points for users. Other cleats 6 may be placed in additional locations for purposes such as to address weight, balance, or center of gravity issues. Unused recesses may be covered with caps or plugs if desired for aesthetic purposes and ease of cleaning, as would be readily apparent to one with ordinary skill in the art.

Figure 4:
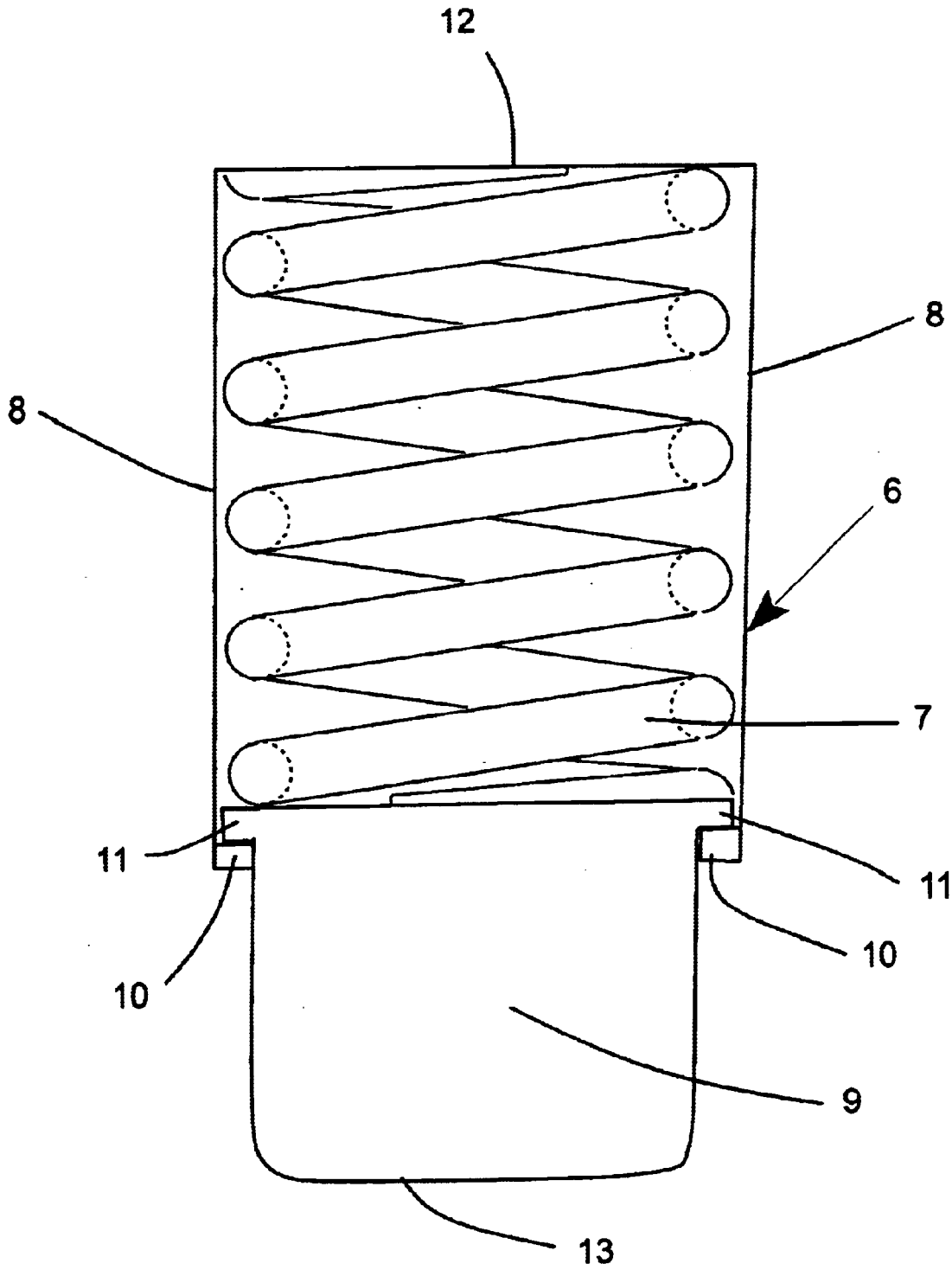
FIG. 4 is a side view of a shock absorber, with an uncompressed spring, according to the preferred embodiment of the invention.

As shown in FIGS. 4 and 5, in the preferred embodiment, shock absorbers 6 contain an internal spring 7 enclosed within walls 8 of the cleat 6. The cleat 6 also contains compressing piece 9, designed to compress the spring 7 when bottom surface 13 of the cleat is in contact with the ground under stress (as when the shoe 1 is in use, supporting the weight of the shoe's wearer). FIG. 5 illustrates cleat 6 under said compressing conditions. Cleat 6 may also contain retaining members 10 and 11, which are designed to retain compression piece 9 together with spring 7 when spring 7 is not compressed. This retaining function is accomplished by contact interaction of members 10 with members 11, as shown in FIG. 4. Cleat 6 may also contain a top retaining wall 12 as shown in FIGS. 4 and 5, which also serves the function of retaining spring 7 enclosed within cleat 6. Alternatively, retaining wall 12 could be omitted, with protective surface 14 then performing the same retaining function as wall 12 when cleat 6 is within recesses 5, as will be apparent from a review of FIGS. 1 and 3 by one with ordinary skill in the art.

The outer portions of compression piece 9 and surface 13 of cleat 6 are preferably made of a non-marking slip resistant hard rubber or plastic composite. The enclosing walls 8 are preferably made of hard plastic or other strong composites. The shape of cleat 6 is preferably generally cylindrical in shape, but may be formed into any geometric shape to fit the sole of the footwear as desired. The diameter of the cleat and enclosing walls 8 may vary with the compression rating of the spring 7, but are preferably no more than ½ inch in diameter. Preferably the cleat will insert into the sole ¼ to 9/16 of an inch and will extend from the sole ¼ to ½ inch when not compressed.

Spring 7 may be of any of various desired sizes or strengths depending on the characteristics and desires of the intended user. Each spring 7 may be independent, having its own compression rating. Typical spring strength ranges could be 1 lb. to 30 lbs. Spring 7 may be made of steel, stainless steel, plastic, rubber or other strong composite with the compression strength desired. In normal walking each person is different in what they feel comfortable in wearing, so the cleats 6 may optionally be made to be interchangeable, adjusting for weight, foot design or personal desire. For example, one person may want more pounds per inch compression to feel the maximum effect of the shock absorption, while another person may want less compression so that their feet feel at a more ground level comfort without giving up all of the advantage of shock absorption to ease the pressure on their feet and in turn reduce the stress on their knees, hips, back and other joints. However, in a preferred embodiment of the footwear 1 with shock absorbers 6, spring 7's strength is selected so that each shoe 1 will absorb half or less of the user's body weight and kinetic force in each step. As such, in the preferred embodiment, when the person is standing on both feet the shock absorbers 6 will be in a fully compressed position as shown in FIG. 3. This will give the person the feel of standing on a normal flat sole surface. For example, if a person's weight is 200 pounds and there is 200 pounds of spring pressure per shoe, insufficient shock absorption would result. Instead, it may be preferable for each shoe to have 100 pounds of spring pressure per shoe to give the maximum effect of shock absorption. The cleat 6 would then become flush with the sole and half of the persons weight per step would be absorbed. It thus would be expected that the shock absorbers 6 for the forword stepping foot would be absorbing 100 pounds of the impact while the shock absorbers 6 for the rearward stepping foot may be complementarily pushing upwards giving a boost effect to the stepping process.

This invention can be used on any type of footwear, including work shoes, boots, sandals, tennis shoes, casual shoes, orthopedic shoes, etc. In addition, the cleats 6 could be used in the heel portion of footwear with high heels such as cowboy boots, casual or dress shoes, even in cases where sufficient sole thickness exists only in the heel. Preferably, the sole 3 of the footwear will be of sufficient thickness in locations where the cleats are used to fully accommodate the shock absorbers, for example ¾ to 1 inch thickness of the sole. However, one benefit that may be provided by the invention is that shock absorption can be increased from regular shoes without necessarily requiring an increase in sole thickness.

Cleats 6 may be made to be interchangeable by the user, to be replaced or changed if desired (e.g. for comfort or if a cleat 6 wears out with use). One additional potential benefit of such an embodiment of the invention could be that the footwear 1 may be made to be convertible between a comfortable walking shoe with high shock absorption qualities to a more responsive athletic shoe with traditional cleats for better responsiveness and traction. This would be done simply by inserting traditional-style cleats into the recesses 5 of shoes that are otherwise acceptable for athletic use. Recesses 5 could be manufactured to accept traditional athletic cleats or, alternatively, traditional-style cleats could be manufactured to fit into the recesses 5 of footwear 1. This benefit could reduce the waste and inconvenience attending the prior art need for users to buy multiple pairs of shoes for use in such different situations.

I claim:

1. A shoe including a sole having a plurality of recesses with a plurality of discrete compressible shock absorbers initially extending from the recesses beyond a lower surface of the sole until weight is placed upon the shoe by its wearer, the total force required to compress all of the plurality of the shock absorbers to a position flush with the lower surface of the sole being equal to a fraction of the anticipated weight of the wearer sufficient to noticeably reduce discomfort upon impact when walking, the compressible shock absorbers comprising a compressing piece extending beyond the shoe sole with a compression spring being positioned in the recesses above the compressing piece, each recess being large enough to receive the spring and a corresponding retracted compressing piece, the compressing piece being flush with a portion of the sole surrounding the compressing piece when retracted so that the remainder of the wearer's weight is born by the shoe sole.

2. The shoe of claim 1 wherein the compressible shock absorbers absorb a fraction of the wearer's weight up to but not exceeding one-half of the anticipated weight of a typical wearer of a shoe of a specific shoe size.

3. The shoe of claim 1 wherein the compressible shock absorbers absorb a total weight of up to one hundred pounds.

4. The shoe of claim 1 wherein the force absorbed by separate shock absorbers on the same shoe being different from the force absorbed by other shock absorbers in different locations, the spring compression of springs in different shock absorbers being different.

5. The shoe of claim 4 wherein shook absorbers located beneath the heel, the big toe and the ball of wear's foot, absorb greater force than shock absorbers positioned at other locations.

6. The shoe of claim 1 wherein compressing pieces are fabricated from non-marking slip resistant material.

7. The shoe of claim 6 wherein the compressing pieces are fabricated from a rubber material.

8. The shoe of claim 6 wherein the compressing pieces are fabricated from a plastic composite material.

9. The shoe of claim 1 wherein each shock absorber comprises a cleat including a compressing piece and a spring positioned within enclosing walls, the enclosing walls and the compressing piece each being fabricated from a plastic material.

10. The shoe of claim 1 wherein the shoe includes a continuous protective wall above the shock absorbers and above the shoe sole, the continuous protective wall comprising means for protecting a wearer's foot form upward pressure created on individual springs.

11. The shoe of claim 1 wherein each compressing piece has a substantially constant cross sectional area.

12. The shoe of claim 11 wherein the outer diameter of the compressing piece is substantially equal to the diameter of the recesses but sufficiently smaller to permit each compressing piece to telescope within the corresponding recess.

13. The shoe of claim 1 wherein the shoe comprises a work shoe.

14. The shoe of claim 1 wherein the shoe comprises a boot.

15. The shoe of claim 1 wherein the shoe comprises an orthopedic shoe.

16. The shoe of claim 1 wherein shock absorbers are centrally positioned on the shoe sole.

17. The shoe of claim 16 wherein three shock absorbers are positioned side by side to be below the location of the ball of a wearer's foot when positioned in the shoe.

* * * * *